United States Patent [19]

Krings

[11] 4,376,599

[45] Mar. 15, 1983

[54] DITCH SHORING UNIT

[76] Inventor: Josef Krings, Hans-Böckler-Strasse 23, 5138 Heinsberg-Oberbruch, Fed. Rep. of Germany

[21] Appl. No.: 227,433

[22] Filed: Jan. 22, 1981

[30] Foreign Application Priority Data

Feb. 9, 1980 [DE] Fed. Rep. of Germany ..... 3004923

[51] Int. Cl.[3] ..... E21D 5/12

[52] U.S. Cl. ..... 405/282; 405/272

[58] Field of Search ..... 405/272–283, 405/145

[56] References Cited

U.S. PATENT DOCUMENTS

| | | | |
|---|---|---|---|
| 3,496,727 | 2/1970 | De Weese et al. | 405/283 |
| 3,530,679 | 9/1970 | Krings | 405/282 |
| 3,782,125 | 1/1974 | Holl | 425/282 |
| 3,903,624 | 9/1975 | Holl | 405/283 X |
| 3,998,067 | 12/1976 | Fernandez | 405/145 |
| 4,224,004 | 9/1980 | Heitkamp | 405/145 |

FOREIGN PATENT DOCUMENTS

| | | | |
|---|---|---|---|
| 160116 | 5/1933 | Switzerland | 405/282 |

*Primary Examiner*—Dennis L. Taylor

*Attorney, Agent, or Firm*—Allison C. Collard; Thomas M. Galgano

[57] ABSTRACT

A ditch shoring unit includes at least a horizontal support frame composed of longitudinally-extending, transversely-adjustable girders made of profile steel parts and having guide heads mounted thereon, as well as a plurality of pile-driving planks which in their cross section, are generally wave-shaped and which are provided on their inner side with a guide channel for a positive locking reception of an associated guide head of the support frame therein. Each pile-driving plank is also provided on its inner side with abutments which are arranged in a vertically, supermposed, spaced-apart manner and locking means are provided on the longitudinal girders of the support frame having a locking element which is moveable into and out of the area between two superimposed abutments of an associated pile-driving plank.

6 Claims, 4 Drawing Figures

DITCH SHORING UNIT

The present invention relates to a ditch shoring unit. More particularly, it relates to such a unit consisting of at least a horizontal support frame including longitudinally-disposed, transversely-adjustable girders made of profiled steel parts which have guide heads mounted thereon, as well as a plurality of pile-driving planks or deal boards having a wave-shaped cross section which are provided on their interior faces with a guide channel for a positive locking reception of an associated guide head of the support frame therein.

With such a ditch shoring unit, it is very time consuming and cumbersome to assemble the individual parts in the ditch to be shored up. Therefore, it would be desirable to preassemble the pile-driving planks on the support frame before its installation, and to mount this structure into the area to be shored up in the form of a ditch shoring basket. However, since the pile-driving planks are freely moveable in a vertical direction with respect to the support frame, such a preassembly was hitherto neither possible nor common.

It is therefore an object of the invention to construct the ditch shoring unit in such a way that it is preassembled outside the ditch before its installation and is then mounted into the ditch area to be protected in the form of a total structure by means of a suitable hoisting device.

This object of the invention is obtained in accordance with the invention in that each pile-driving deal board is provided on its inner side with abutments which are arranged in a vertically-superimposed, spaced-apart manner. In addition, locking means are provided on the longitudinal girders of the support frame having a locking element which is moveable into and out of the area between two superimposed, adjacent abutments of an associated pile-driving board.

Due to this measure, the moveability of the pile-driving boards is limited to the axial movement thereof within the relatively short distance between two superimposed, adjacent abutments; the pile-driving boards being only axially moveable because of the positive locking of the guiding heads. As a result, the preassembled ditch shoring unit can be moved in the intended manner.

Other objects and features of the present invention will become apparent from the following detailed description when taken in connection with the accompanying drawings which disclose one embodiment of the invention. It is to be understood that the drawings are designed for the purpose of illustration only and are not intended as a definition of the limits of the invention.

In the drawings, wherein similar reference characters denote similar elements throughout the several views.

Figure 1:
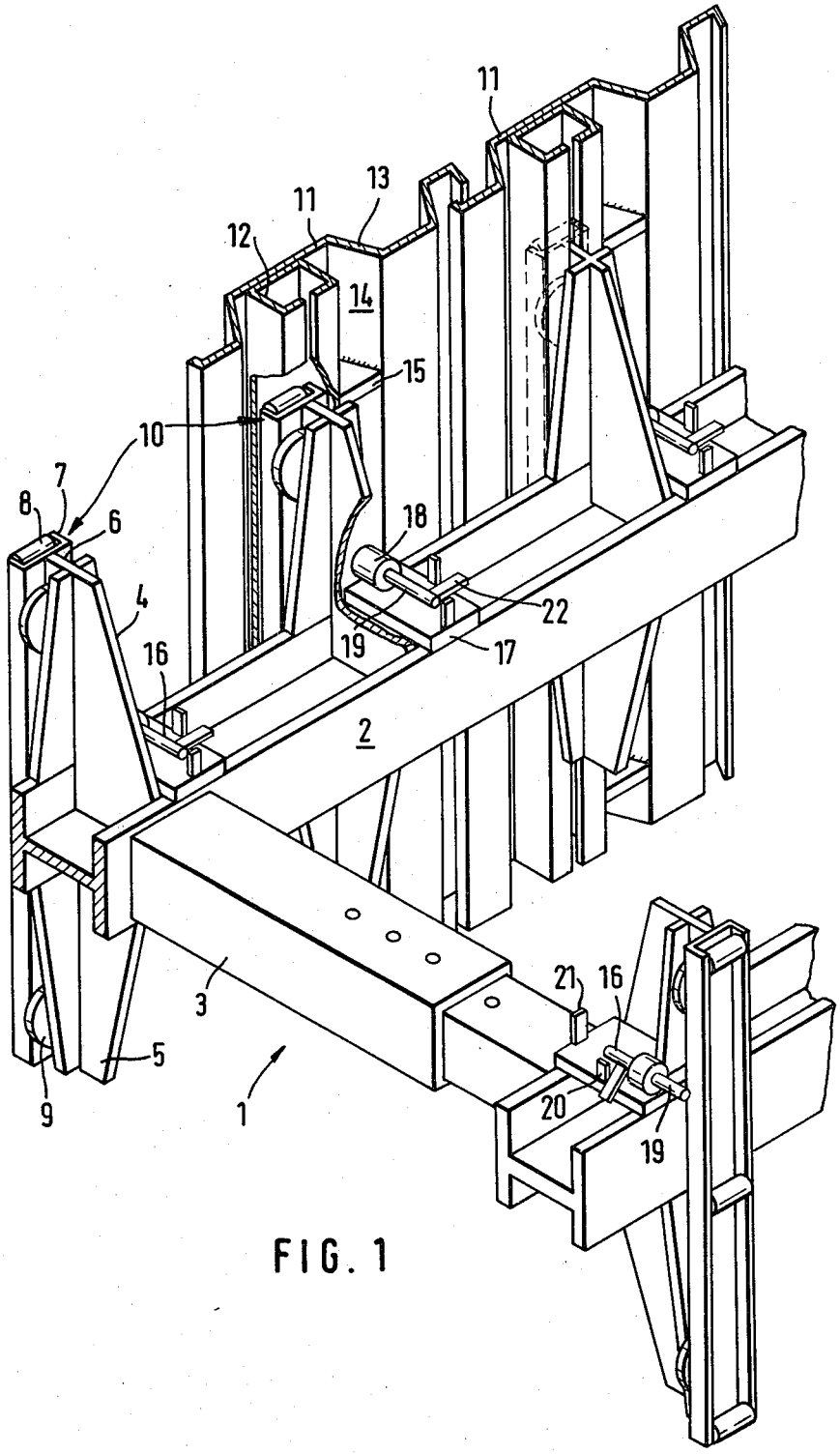
FIG. 1 is a perspective view of a ditch shoring unit in accordance with the invention.
Figure 2:
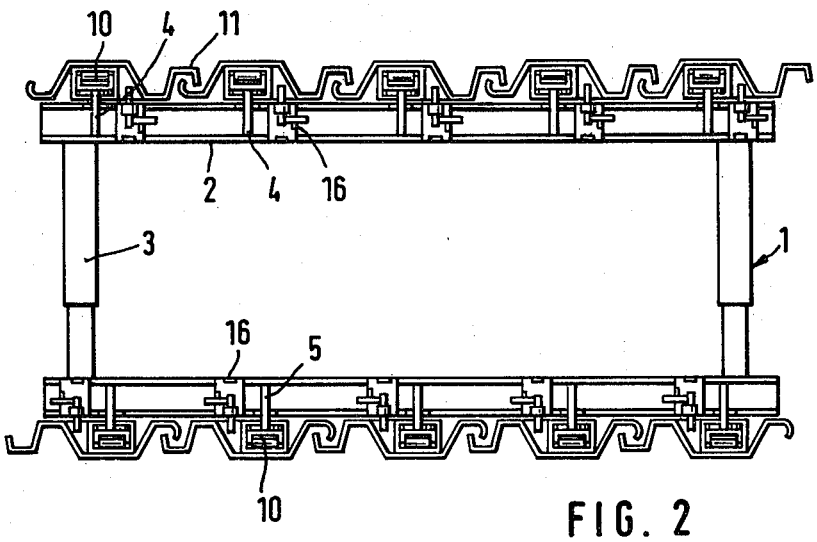
FIG. 2 is a plan view of the ditch shoring unit.

In accordance with FIGS. 1 and 2, the ditch shoring unit consists of a rigid support frame 1 which, in turn, consists of two longitudinally-disposed, spaced-apart girders 2 and two longitudinally-adjustable struts 3 interposed therebetween which are coupled to the girders at their ends. Longitudinal girders 2 consist of profiled or channeled steel supports or beams.

Guide means 4 are provided and distributed at a regular distance apart on longitudinal girders 2. Guide means 4 each consist of welded gusset plates 5 which are disposed above and below longitudinal girders 2 with an outwardly-extending rib 6 on which a vertical U-shaped channel 7 is welded which opens to the outside. In U-shaped channel 7, support rollers 8 are mounted which rotate about horizontally-disposed axles.

At the rear side of the U-shaped channel 7, disk-like rollers 9 are mounted in recesses of rib 6 which are rotatable around horizontal axles, normally disposed with respect to the axles of rollers 8. Channel 7 and rollers 8, 9 form a guide head 10.

A plurality of pile-driving planks or deal boards 11 are associated with support frame 1. These pile-driver planks 11 have a wave-shaped profile which is shaped so that the ends of adjacent pile-driving planks 11 may overlap. An elongated, C-shaped support 12 is welded on an outwardly-extending bevel or ridge of each pile-driver plank 11, in which an associated guide head 10 is received in a positively-locked manner. Consequently, pile-driver plank 11 is guided vertically with respect to support frame 1.

A plurality of abutments 15, which serve as horizontal partition bottoms, are welded in the remaining hollow profile or channel 14 between C-shaped support 12 and side plate 13 of pile-driver board 11 at a uniform distance vertically apart from each other.

Figure 3:
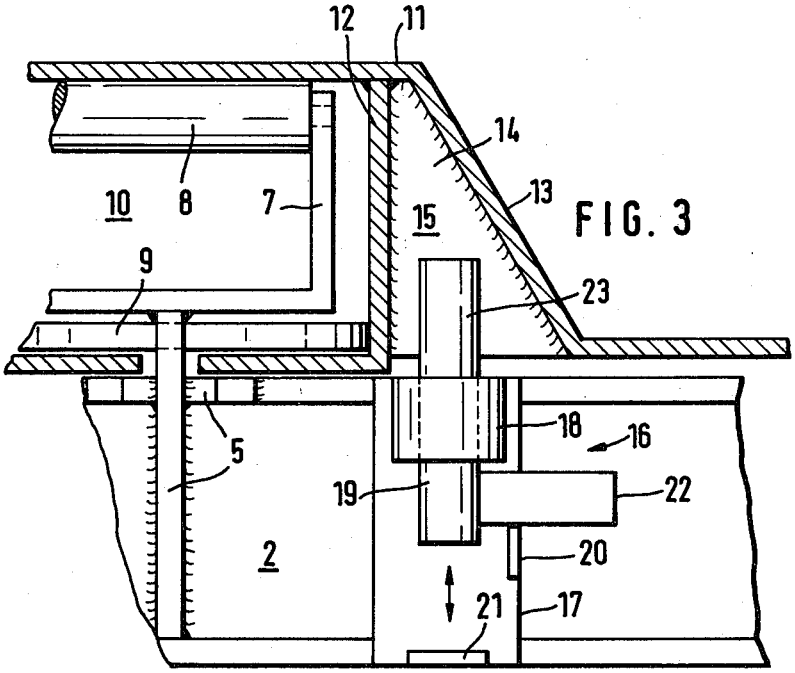
FIG. 3 is an enlarged, fragmentarily-illustrated plan view of the ditch shoring unit and the locking means employed therein.
Figure 4:
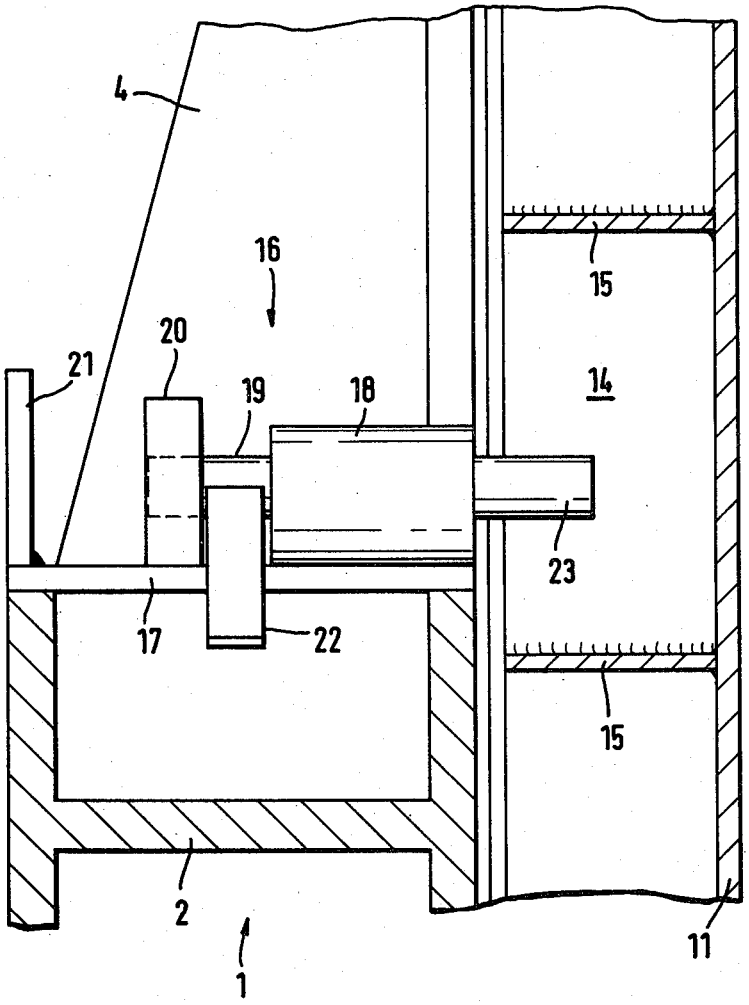
FIG. 4 is an enlarged, fragmentarily-illustrated side view of the ditch shoring unit and the locking means employed therein.

In addition to guide means 4, locking means 16 is provided for each pile-driving plank 11 mounted on longitudinal girders 2 of support frame 1. Locking means 16 is shown in an enlarged scale in FIGS. 3 and 4.

Each locking means 16 consists of a base plate 17 mounted on the corresponding longitudinal girder 2, a support block or hand-lever bearing 18 mounted on base plate 17, a locking bolt 19 which is moveable in an axial direction which is transverse to the longitudinal direction of longitudinal girder 2, and abutments 20, 21. Abutment 20 is mounted laterally of the locking bolt 19 and serves as an abutment for locking lever 22 mounted on locking bolt 19. Locking lever 22 is mounted in a radially-projecting manner on locking bolt 19. Abutment 21 is mounted axially displaced from locking bolt 19 and it limits its rearward stroke.

In its arresting position (FIGS. 3 and 4), the front part 23 of locking bolt 19 extends into the space of the hollow profile 14 and abuts, during relative movement between support frame 1 and pile-driving plank 11, one of the upwardly or downwardly limiting partition bottoms or abutments 15. Release from this arresting position is effected by rotating locking bolt 19 and the associated locking lever 22 a quarter turn, as well as by retracting locking bolt 19 against abutment 21. Thereby, pile-driving plank 11 is freely moveable with respect to support frame 1.

In operation, the total ditch shoring unit can be preassembled outside of the ditch to be shored up and can be lowered into the more or less deep trench by means of a suitable hoisting device. Thereafter, the pile-driver planks may be driven deeper into the ground after being unlocked. Due to the preassembly of the ditch shoring unit, considerable mounting and adjusting operations are eliminated. At the same time, it provides preliminary protection with respect to the interior of the ditch.

In order to again pull the ditch shoring unit out of the refilled ditch, one again locks the support frame with the pile-driving planks and the unit is ready to be hoisted out of the ditch by the hoisting means.

Thus, while only one embodiment of the present invention has been shown and described, it will be obvious that many changes and modifications may be made thereunto, without departing from the spirit and scope of the invention.

What is claimed is:

1. A ditch shoring unit comprising:

a horizontal support frame including at least one longitudinal girder having a plurality of spaced-apart, transversely-disposed guide heads mounted thereon, said guide heads having at least one rotatable roller mounted thereon;

a plurality of overlapping, vertically-disposed pile-driving deal boards, each of which has a wave-shaped cross section and a vertically-extending generally C-shaped guide channel provided on an inside surface thereof in which an associated guide head of said girder is received for positive locking and sliding reception therein, said deal boards also having a second vertically-extending channel on said inside surface thereof adjacent to said C-shaped guide channel and a plurality of vertically-superimposed, spaced-apart abutments which serve as horizontal partitions formed on the inside surface thereof; and a plurality of locking means mounted on said longitudinal girder for each of said deal boards, each of said locking means including a retractable locking element moveable into and out of the area between two superimposed abutments of an associated deal board for restricting and allowing free movement thereof, respectively.

2. The ditch shoring unit according to claim 1, wherein said locking element of said locking means comprises a locking bolt having a radially-extending lever arm joined thereto and wherein said locking means further includes a support bearing through which said locking bolt is guided and a locking abutment disposed laterally of said locking bolt for coaction with said locking lever arm.

3. The ditch shoring unit according to claim 1, wherein said frame comprises a plurality of said beams which are made of profiled steel parts.

4. The ditch shoring unit according to claim 1, wherein said guide head comprises a vertically-extending, generally U-shaped guide channel having a U-shaped channel and a plurality of said rollers defining a first set which are rotatably mounted within said U-shaped channel thereof, vertically spaced apart from one another, supported by means of horizontally-disposed axles.

5. The ditch shoring unit according to claim 4, wherein said guide head comprises a second set of vertically, spaced-apart rollers rotatably mounted on said guide channel outwardly of said channel thereof supported by means of horizontally-disposed axles which are disposed normal to the axles of said first set of rollers.

6. The ditch shoring unit according to claim 5, wherein said second vertically-extending channel is defined in part by one wall of said C-shaped guide channel and an interior wall portion of said deal board.

* * * * *